US012460488B2

(12) United States Patent
Uddin et al.

(10) Patent No.: US 12,460,488 B2
(45) Date of Patent: Nov. 4, 2025

(54) FLOW CONTROL CHOKE WITH WEAR DECOUPLING

(71) Applicant: Halliburton Energy Services, Inc., Houston, TX (US)

(72) Inventors: Hasib Uddin, Houston, TX (US); Adnan Zaman, Houston, TX (US); Steven Graham Bell, Houston, TX (US); Bryan Restau, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/745,721

(22) Filed: Jun. 17, 2024

(65) Prior Publication Data

US 2025/0012154 A1 Jan. 9, 2025

Related U.S. Application Data

(60) Provisional application No. 63/524,766, filed on Jul. 3, 2023.

(51) Int. Cl.

| | |
|---|---|
| ***E21B 21/10*** | (2006.01) |
| ***E21B 4/00*** | (2006.01) |
| ***E21B 4/02*** | (2006.01) |
| ***E21B 7/06*** | (2006.01) |

(52) U.S. Cl.

CPC ..... *E21B 21/10* (2013.01); *E21B 4/003* (2013.01); *E21B 4/02* (2013.01); *E21B 7/06* (2013.01)

(58) Field of Classification Search

CPC ..... E21B 21/10; E21B 4/003; E21B 4/02

See application file for complete search history.

(56) References Cited

U.S. PATENT DOCUMENTS

| | | | |
|---|---|---|---|
| 5,351,766 | A | 10/1994 | Wenzel et al. |
| 6,244,361 | B1 | 6/2001 | Comeau et al. |
| 6,340,063 | B1 | 1/2002 | Comeau et al. |
| 7,306,058 | B2 | 12/2007 | Cargill et al. |
| 9,869,136 | B2 | 1/2018 | Gharib et al. |
| 10,060,188 | B2 | 8/2018 | Gharib et al. |
| 10,273,757 | B2 | 4/2019 | Savage et al. |
| 10,301,876 | B2 | 5/2019 | Savage et al. |
| 10,605,311 | B2 | 3/2020 | Park et al. |
| 11,371,288 | B2 | 6/2022 | D'Silva et al. |
| 11,643,883 | B1 | 5/2023 | Hardin et al. |
| 11,655,678 | B2 | 5/2023 | Munguia et al. |

(Continued)

OTHER PUBLICATIONS

International Search Report and Written Opinion for International Patent Application No. PCT/US2024/035658 dated Oct. 15, 2024. PDF file. 7 pages.

*Primary Examiner* — Taras P Bemko

(74) *Attorney, Agent, or Firm* — Benjamin Ford; C. Tumey Law Group PLLC

(57) ABSTRACT

Shown and described herein is a choke assembly for use with a downhole drill string. The choke assembly may include a rotating choke carrier, a stationary seat disposed on the rotating choke carrier and a rotating choke positioned adjacent to the stationary seat to create a seal surface. The choke assembly may further comprise a biasing mechanism applying a biasing force to press the rotating choke against the stationary seat and a flow port within the stationary seat which controls drilling fluid to allow some drilling fluid to become a bypass fluid and pass through the stationary seat.

18 Claims, 5 Drawing Sheets

(56) References Cited

U.S. PATENT DOCUMENTS

| | | | |
|---|---|---|---|
| 11,686,156 | B2 | 6/2023 | Munguia et al. |
| 11,946,373 | B2 | 4/2024 | Uddin et al. |
| 2002/0185314 | A1 | 12/2002 | Cargill et al. |
| 2016/0186748 | A1 | 6/2016 | Underwood |
| 2016/0230466 | A1* | 8/2016 | Purohit ..... E21B 7/067 |
| 2016/0245021 | A1* | 8/2016 | Leitko, Jr. ..... F16C 19/545 |
| 2017/0260814 | A1 | 9/2017 | Gharib et al. |
| 2017/0335628 | A1 | 11/2017 | Savage et al. |
| 2019/0153820 | A1 | 5/2019 | Lorenson et al. |
| 2023/0011364 | A1 | 1/2023 | Munguia et al. |
| 2023/0167685 | A1 | 6/2023 | Munguia et al. |
| 2023/0184058 | A1 | 6/2023 | Uddin et al. |

* cited by examiner

FLOW CONTROL CHOKE WITH WEAR DECOUPLING

CROSS-REFERENCE TO RELATED APPLICATIONS

This application claims priority to U.S. Provisional Application No. 63/524,766 filed on Jul. 3, 2023, which is herein incorporated by reference in its entirety.

BACKGROUND

Directional drilling involves drilling a borehole that deviates from a vertical path, such as drilling horizontally through a subterranean formation. Drilling motor (often called mud motor) and Rotary steerable systems (RSS) are employed to control the direction of a drill bit while drilling. Typically, in a point-the-bit rotary steerable system, an internal shaft within the system is deflected to direct the drill bit and in a push-the-bit rotary steerable system, a pad pushes against the subterranean formation to direct the bit. Both the designs can be dependent on hydraulically operated mechanisms. Additionally, a BHA (Bottomhole Assembly) can be comprised of other hydraulically operated devices, e.g. a downhole turbine. Drilling mud is pumped from the surface that goes through the drill pipes, BHA (RSS, L/MWD tools, drill bit) etc. and gets circulated back to the surface through the annular space between the borehole and the drill string.

A drilling motor usually has a power section that has a stator and rotor where the Moincu principle is employed to generate rotation and torque by positive displacement of flowing mud that is being pumped from the surface. The power is then transmitted through a shaft to the lower section of the drilling motor which is connected to the drill bit through a drive shaft. The lower section typically has bearings to take radial loads and thrust loads and hence it is called bearing section. A motor bearing section can be completely sealed or unsealed. For an unsealed bearing section, a fraction of the pumped mud flow bypasses to the annulus while the majority of the mud flow goes through the driveshaft to the drill bit and exits to the annulus through the bit nozzles. A minimum amount of bypass flow in the bearing section is desired in order to provide sufficient cooling flow for the bearing parts. However, excessive bypass flow can lead to erosion wear in the bearing section causing pre-mature bearing failure and at the same time reduction for hydraulic efficiency of the drill bit due to lack of mud flow.

In MARSS (Motor assisted rotary steerable system) application, a mud motor is attached above the RSS and typically push-the-bit rotary steerable system is popular in such applications. The motor provides additional RPM and torque to RSS which in turn increases the ROP (rate of penetration) and increases the drilling efficiency by many folds. The bearing section of a motor in MARSS system may be scaled and lubricated by internal oil, or unscaled and lubricated by bypassed mud flow while majority of the drilling mud flows through the drive shaft to the BHA (other L/MWD tools, pulsar etc.) including the RSS and finally the drill bit before it exits to the annulus. For an unsealed bearing section, loss of main drilling fluid to the annulus is inevitable due to bearing tolerances, manufacturing constraints, and erosive wear from the flowing mud. The bypassed fluid flow to annulus can be used to lubricate the bearing section, but the flow must be controlled or limited so that enough mud flow is available for the tools below the motor for example, to provide pad force in the push the bit rotary steerable system used to steer the drill bit while. A downhole turbine in a MARSS system also seats below the motor and depends on the amount of incoming flow to generate power.

Unsealed mud motors are popularly used for MARSS drilling operations for their own advantages, especially being able to avoid a sudden seal failure of a sealed motor that can cause a sudden and excessive flow loss to the annulus. By design, unsealed mud motors allow some acceptable amount of flow to be bypassed to the annulus through the bearing section while majority of the flow goes through the driveshaft to the BHA below motor. This bypass amount must be controlled and for a MARSS application, the performance and success of a rotary steerable system is highly dependent on the residual flow going through BHA below motor after some bypass to annulus that happens at the unsealed bearing section. Typically, the tight radial bearing gaps perform as the main restriction at the mud motor bearing section that controls the bypass mud flow through the bearings and into the annulus. However, as the run progresses the radial bearing can rapidly wear out and the flow restriction drops drastically which in turn results in excessive flow loss through the bearing section. A flow control choke has been invented previously [REF] that provides resistance in the amount of bypass flow in addition to the radial bearings. This flow control choke mechanism relies on blocking the bearing section flow path by a seal contact between a part that rotates with the drive shaft and another part that is stationary with bearing housing. The stationary part has narrow flow ports/orifices that control the bypass amount through the bearing section in addition to the radial bearings. However, robustness, reliability and functionality of this flow control choke is highly dependent on how much abrasion wear and erosion wear it can handle. Moreover, abrasion wear and erosion wear may be formed at or near the same location and if that happens, one wear mechanism will negatively impact the other mechanism which accelerate the failure of the flow control choke. It is possible to cause erosion at the flow ports/orifices which are right at the metal-to-metal contact surface, or right next to the contact surface, of the rotating and stationary part of the flow control choke, and eventually compromise the metal-to-metal contact surface and cause accelerated abrasion (or 3-body abrasion—two metal and abrasive particles in the mud). As a result, no flow restriction/choking capability will be left at the choke mechanism since the flow will start flowing through the contact area in addition to the flow ports/orifices. Conversely, it is also possible to cause severe metal-to-metal abrasion at the contact surfaces which will deteriorate flow behavior right at the entry of the high-speed flow ports and cause accelerated erosion and eventually will lead to excessive bypass flow.

BRIEF DESCRIPTION OF THE DRAWINGS

These drawings illustrate certain aspects of some of the embodiments of the present disclosure and should not be used to limit or define the systems, assemblies, and methods herein.

DETAILED DESCRIPTION

Figure 1:
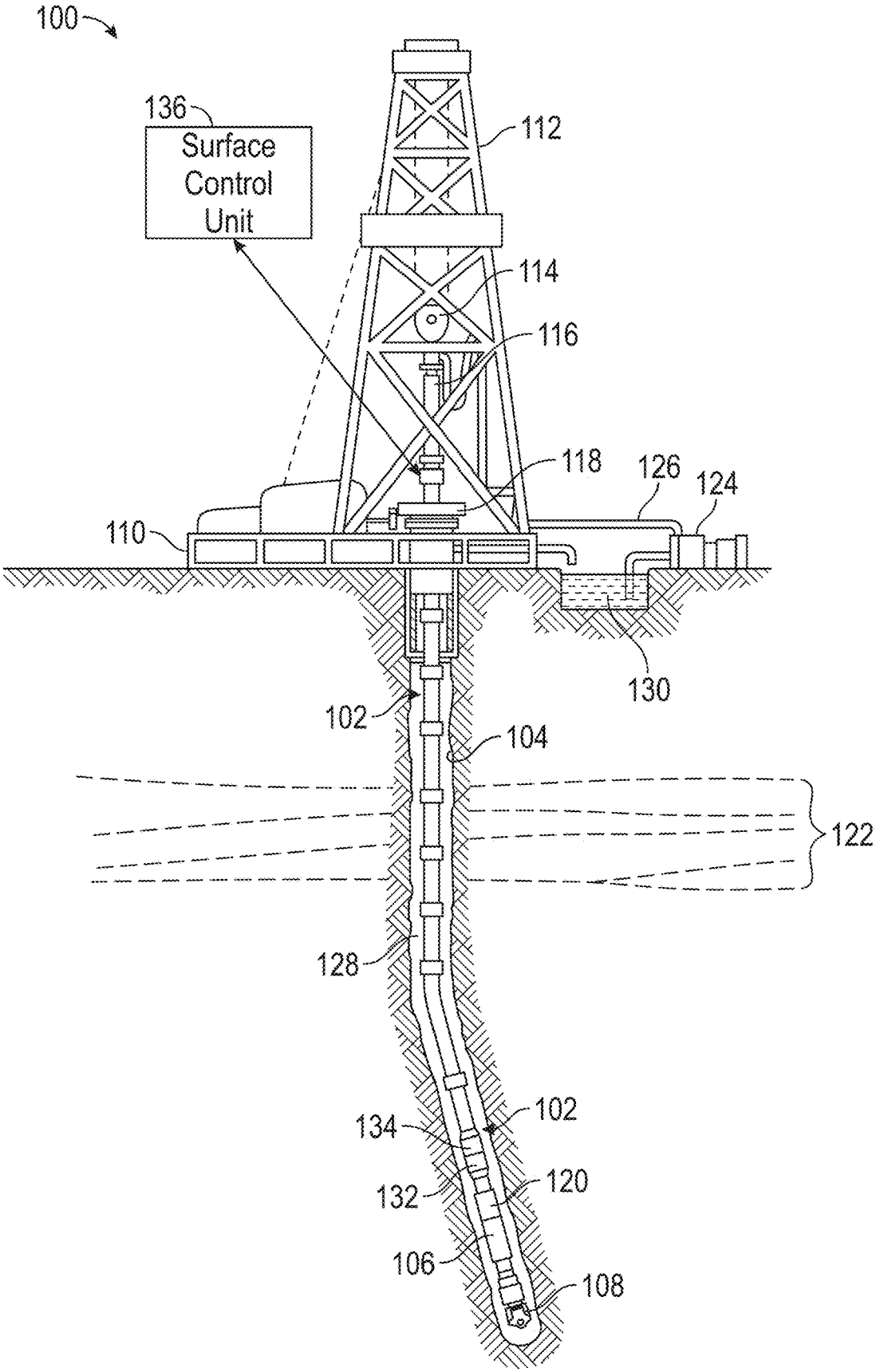
FIG. 1 is a schematic view of a drilling system, according to one or more embodiments.

The present disclosure provides a mud motor bearing assembly for use with a drilling system. The bearing assembly comprises radial bearings, thrust bearings, and/or ball bearings or roller bearings that support a driveshaft that extends between the mud motor and a drill bit. The bearing assembly also comprises a fluid flow path through the bearings and into an annulus surrounding the bearing assembly that allows main drilling fluid to pass through the bearings, lubricating and cooling the bearings. The bearing assembly also comprises a choke assembly that restricts the flow of main drilling fluid through the bearings.

Flow control chokes are sometimes used to control the amount of bypass flow into the radial bearing section. This choke mechanism takes the main responsibility of controlling the bypass flow by taking most of the pressure differential. As a result, the radial bearings can have a longer life. As this choke design relies on a metal-to-metal seal and flow restricting orifices, abrasion wear and erosion wear become the major reason for their failure or loss of functionality. The embodiments herein seek to separate the above-mentioned wear mechanisms. Thus, the embodiments herein provide an innovative way to separate two wear mechanisms and hence tremendously increase the life and reliability, and also provides opportunity to use different materials for abrasion resistance and erosion resistance.

Although the bearing assembly may be used with many types of drilling systems having a mud motor, the bearing assembly is particularly applicable to a motor-assisted rotary steerable system ("MARSS"). A MARRS utilizes a main drilling fluid that has passed through the mud motor and the bearing assembly, to extend pads to push the drill bit in a desired direction. By restricting the flow of main drilling fluid through the bearings of the bearing assembly, the choke assembly maintains the main drilling fluid passing through the bearing assembly to the pads at a sufficient pressure to extend the pads.

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well may comprise, without limitation, an oil, gas, or water production well, or an injection well. As used herein, a "well" comprises at least one borehole having a borehole wall. A borehole may comprise vertical, inclined, and horizontal portions, and it can be straight, curved, or branched. As used herein, the term "borehole" comprises any cased, and any uncased, open-hole portion of the borehole. Further, the term "uphole" refers to a direction that is towards the surface of the well, while the term "downhole" refers to a direction that is away from the surface of the well.

FIG. 1 is a schematic view of a drilling system 100, according to one or more embodiments. Drilling system 100 of the present disclosure will be specifically described below such that the system is used to direct a drill bit in drilling a wellbore, such as a subsea well or a land well. Further, it will be understood that the present disclosure is not limited to only drilling an oil well. The present disclosure also encompasses natural gas wellbores, other hydrocarbon wellbores, or wellbores in general. Further, the present disclosure may be used for the exploration and formation of geothermal wellbores intended to provide a source of heat energy instead of hydrocarbons.

FIG. 1 shows a drill string 102 disposed in a directional borehole 104. Drill string 102 comprises a push-the-bit rotary steerable system ("RSS") 106 that provides full 3D directional control of the drill bit 108. A drilling platform 110 supports a derrick 112 having a traveling block 114 for raising and lowering a drill string 102. A kelly 116 supports the drill string 102 as the drill string 102 is lowered through a rotary table 118. Alternatively, a top drive may be used to rotate drill string 102 in place of kelly 116 and rotary table 118. A drill bit 108 may be positioned at the downhole end of drill string 102 and is driven by rotation of the entire drill string 102 from the surface and/or by a downhole motor 120 positioned on drill string 102. As bit 108 rotates, bit 108 forms borehole 104 that passes through various formations 122. A pump 124 circulates main drilling fluid through a feed pipe 126 and downhole through the interior of drill string 102, through orifices in drill bit 108, back to the surface via annulus 128 around drill string 102, and into a retention pit 130. The main drilling fluid transports cuttings from borehole 104 into pit 130 and aids in maintaining the integrity of borehole 104. The main drilling fluid also drives downhole motor 120, as discussed in more detail below.

Drill string 102 may comprise one or more logging while drilling (LWD) or measurement-while-drilling (MWD) tools 132 that collect measurements relating to various borehole and formation properties as well as the position of bit 108 and various other drilling conditions as bit 108 extends borehole 104 through formations 122. LWD/MWD tool 132 may comprise a device for measuring formation resistivity, a gamma ray device for measuring formation gamma ray intensity, devices for measuring the inclination and azimuth of the drill string 102, pressure sensors for measuring main drilling fluid pressure, temperature sensors for measuring borehole temperature, etc.

Drill string 102 may also comprise a telemetry module 134. Telemetry module 134 receives data provided by the various sensors of drill string 102 (e.g., sensors of the LWD/MWD tool 132), and transmits the data to a surface unit 136. Data may also be provided by surface unit 136, received by telemetry module 134, and transmitted to the tools (e.g., LWD/MWD tool 132, rotary steering tool 106, etc.) of drill string 102. Mud pulse telemetry wired drill pipe, acoustic telemetry, or other telemetry technologies known in the art may be used to provide communication between surface control unit 136 and telemetry module 134. Surface unit 136 may also communicate directly with LWD/MWD tool 132 and/or rotary steering tool 106. Surface unit 136 may be a computer stationed at the well site, a portable electronic device, a remote computer, or distributed between multiple locations and devices. Unit 136 may also be a control unit that controls functions of the equipment of drill string 102.

Figure 2:
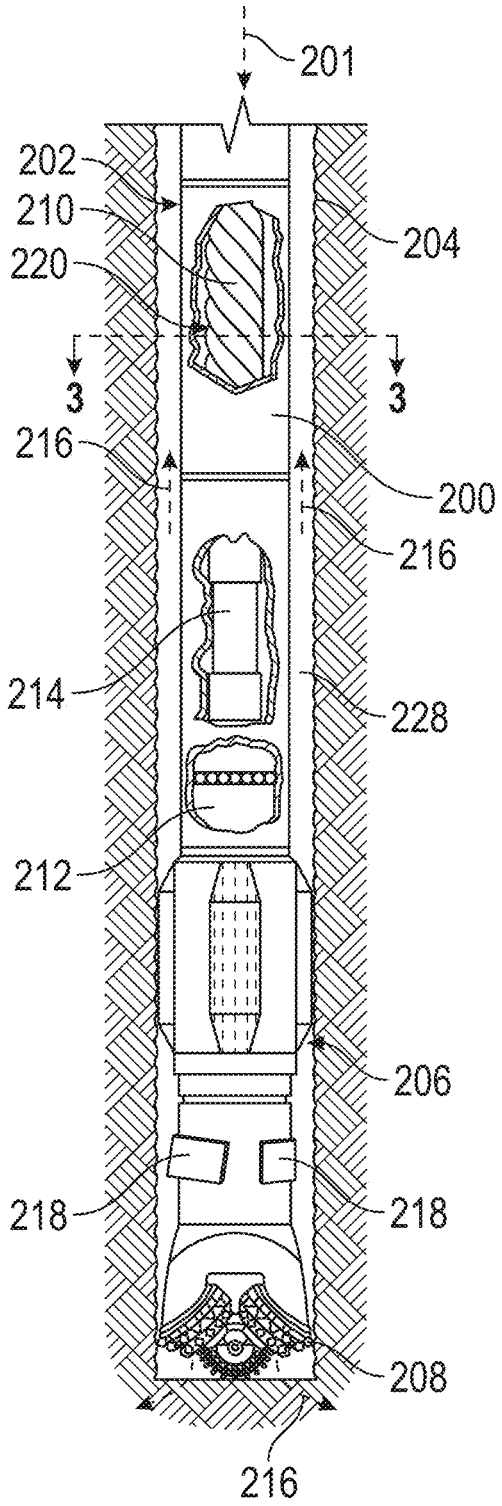
FIG. 2 is a portion of a drill string disposed in a borehole, according to one or more embodiments.
Figure 3:
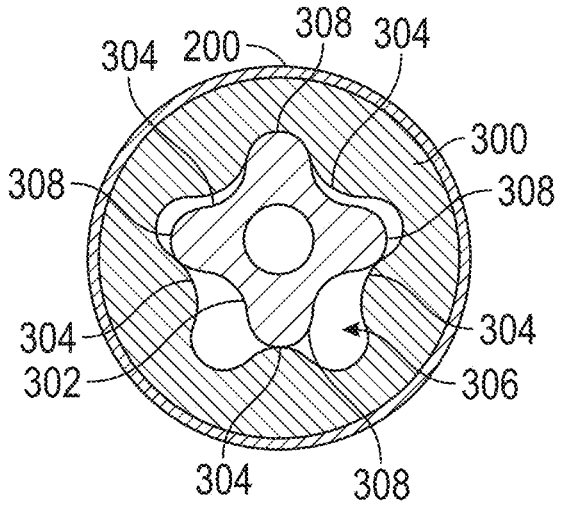
FIG. 3 is a cross-sectional view of the stator and rotor of FIG. 2.

FIG. 2 is a portion of a of a drill string 202 disposed in a borehole 204 and comprises a downhole motor 220 connected to a drill bit 208. FIG. 3 is a cross-sectional view of stator 300 and rotor 302 also indicated in FIG. 2. Downhole motor 220 preferably comprises a tubular housing 200 that encloses a power unit 210. Power unit 210 is connected to a bearing assembly 212 via a transmission unit 214. Bearing assembly 212 supports a driveshaft (not shown) extending between downhole motor 220 and drill bit 208 to rotate drill bit 208.

Referring to FIG. 3, power unit 210 comprises a stator 300 and a rotor 302. Stator 300 comprises multiple (e.g., five) lobes 304 extending along stator 300 in a helical configuration and defining a cavity 306. Rotor 302 also comprises lobes 308 extending along rotor 302 in a helical configuration. Stator 300 and rotor 302 may also have more or fewer lobes where the difference between rotor lobes 308 and stator lobes 304 is one extra stator lobe 304 for the number of rotor lobes 308.

Rotor 302 is operatively positioned in cavity 306 such that the rotor lobes cooperate with stator lobes 304 in that applying fluid pressure to cavity 306 by flowing fluid within cavity 306 causes rotor 302 to rotate within stator 300. For example, referring to FIGS. 2 and 3, pressurized main drilling fluid (e.g., drilling mud) 216 may be introduced at an upper end of the power unit 210 and forced down through cavity 306. The pressurized main drilling fluid 216 entering cavity 306, in cooperation with lobes 304 of stator 300 and the geometry of stator 300 and rotor 302 causes rotor 302 to turn to allow main drilling fluid 216 to pass through motor 220, thus rotating rotor 302 relative to stator 300. Main drilling fluid 216 subsequently exits through ports (e.g., jets) in drill bit 208 and travels upward through an annulus 228 between drill string 202 and borehole 204 and is received at the surface where it is captured and pumped down drill string 202 again.

As shown in FIG. 2, an RSS 206 is positioned on drill string 202 downhole of downhole motor 220. Main drilling fluid 216 passes through downhole motor 220 and then through bearing assembly 212, where a portion of main drilling fluid 216 is diverted and used to cool and lubricate the bearings within bearing assembly 212, as described in more detail below. The diverted main drilling fluid 216 passes through the bearings and into annulus 228. After the main drilling fluid that was not diverted passes through bearing assembly 212, main drilling fluid 216 provides the hydraulic pressure necessary to extend pads (one indicated, 218) of RSS 206 to direct the drill bit 208. In order to provide sufficient pressure to extend pads 218 of RSS 206, the amount of main drilling fluid 216 diverted through the bearings (i.e. bypass fluid) must be controlled to maintain the amount of hydraulic pressure available to extend pads 218 above an appropriate amount.

Figure 4:
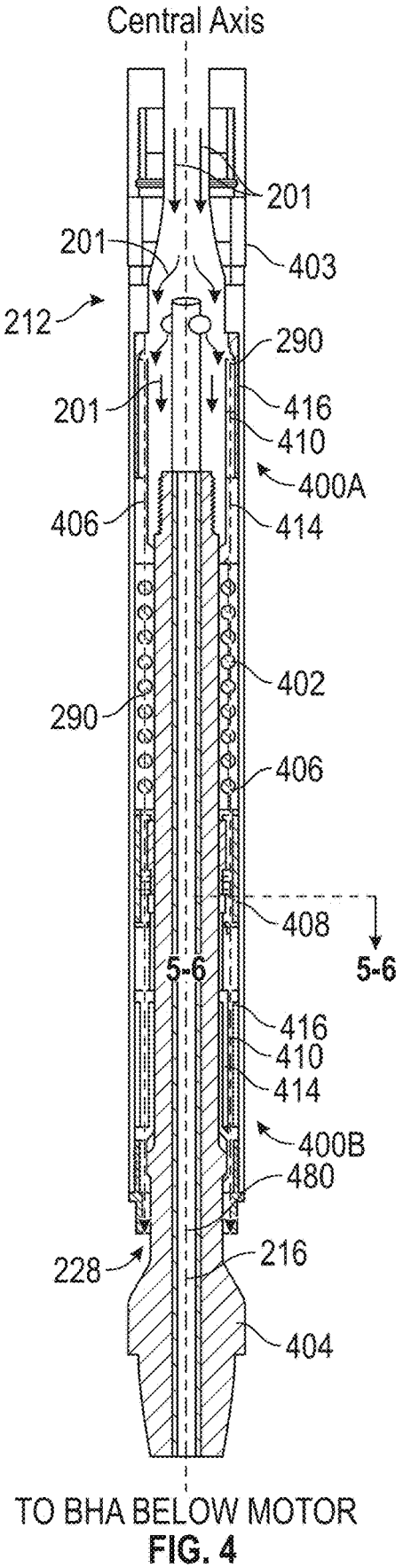
FIG. 4 is a cross-sectional view of a bearing assembly, according to one or more embodiments.

Turning now to FIG. 4, FIG. 4 is a bearing assembly 212, according to one or more embodiments. Bearing assembly 212 comprises radial bearing assemblies 400 and ball bearings 402 or roller bearings (not shown) that are positioned circumferentially around a driveshaft 404 that extends between downhole motor 220 and drill bit 208 to support driveshaft 404. Bearing assembly 212 may also comprise one or more thrust bearings. As shown, there are two bearing assemblies 400 used in this embodiment but other arrangements may be used for other embodiments. As shown here, upper bearing assembly 400A may be positioned at the upper portion of drive shaft 404 while a lower bearing assembly 400B may be positioned at lower portion of the drive shaft 404.

The total drilling fluid 201 may be pumped down hole and through the center of the tool string along the central axis before splitting into two separate flows just before reaching upper bearing assembly 400A. The majority of the total drilling fluid 201 continues down the central bore of drive shaft 404, while bypass fluid 290 is diverted into a bypass fluid flow path 406 which extends from the bore of drive-shaft 404, through bearings 400, 402, as well as though choke assembly 408. As discussed above, a portion of the total drilling fluid 201 may be diverted through bypass fluid flow path 406 to cool and lubricate bearings 400, 402. A choke assembly 408, discussed in more detail below, may be disposed within the bypass fluid flow path 406. Choke assembly 408 controls the amount of bypass fluid 290 that passes through bypass fluid flow path 406 and into an annulus 228 surrounding bearing assembly 212, for example, by restricting flow out of bypass fluid flow path 406 and into annulus 228. By controlling the amount of main drilling fluid passing into the annulus via bypass fluid flow path 406, sufficient hydraulic pressure is maintained in the main drilling fluid flowing through driveshaft 404 to extend pads 218 of RSS 206.

In at least one embodiment, one or both of the radial bearing assemblies 400 may also act to restrict the flow of fluid through the bypass fluid flow path 406. Specifically, an optional gap 410 formed between an inner cylinder 414 and an outer cylinder 416 may be sized to further restrict the flow of bypass fluid through the gap 410 and, thus, the bypass fluid flow path 406.

Figure 5:
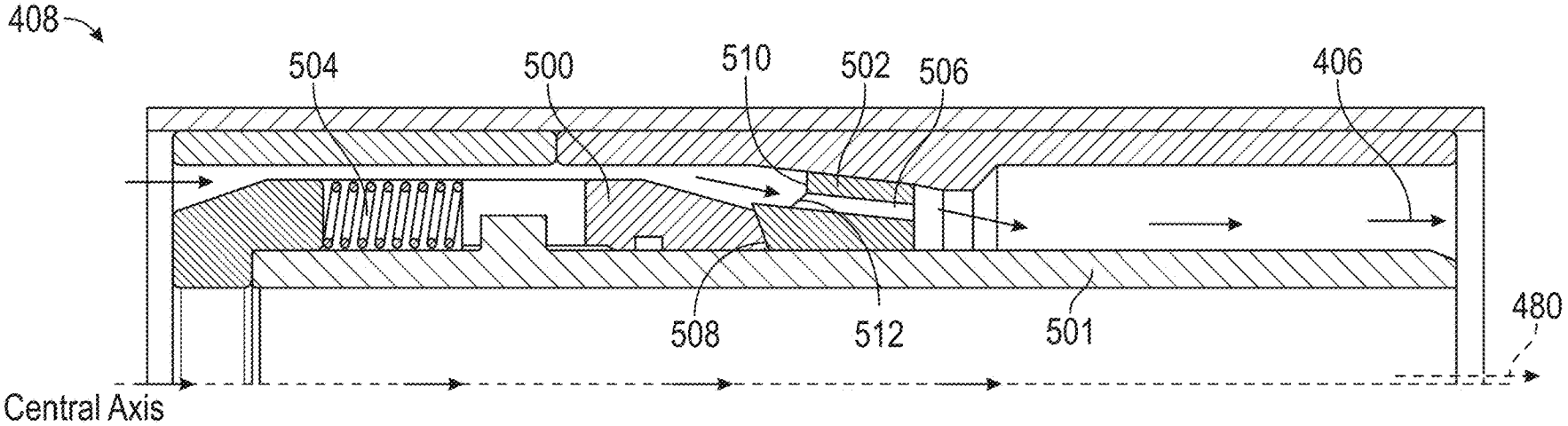
FIG. 5 is a cross-sectional view of a choke assembly positioned within the bearing assembly of FIG. 4.

FIG. 5 is cross-sectional view of one embodiment for choke assembly 408 positioned within bypass fluid flow path 406 of bearing assembly 212 of FIG. 4. This choke assembly 408 comprises a rotating choke 500 that contacts a stationary seat 502, disposed on a rotating choke carrier 501, to restrict the amount of main drilling fluid passing through the bypass fluid flow path 406. Rotating choke carrier 501 preferably shares a central axis with the drill string 102/202. Biasing mechanism 504, such as a spring, exerts a biasing force on rotating choke 500 in a downhole direction based on the expected pressure of the bypass fluid and the pressure within the borehole annulus. Biasing mechanism 504 may also be disposed on rotating choke carrier 501. Preferably, rotating choke carrier 501 shares a central axis with drill string 102. In other embodiments, stationary seat 502 may be uphole of rotating choke 500 and biasing mechanism 504 may exert a biasing force on the choke in an uphole direction based on the expected pressure of the bypass fluid and the pressure within the borehole annulus. It should be noted that the biasing force may also be applied without biasing mechanism 504. For example, a biasing force may be applied by hydraulics, magnetics, electronics, and/or the like.

Figure 6:
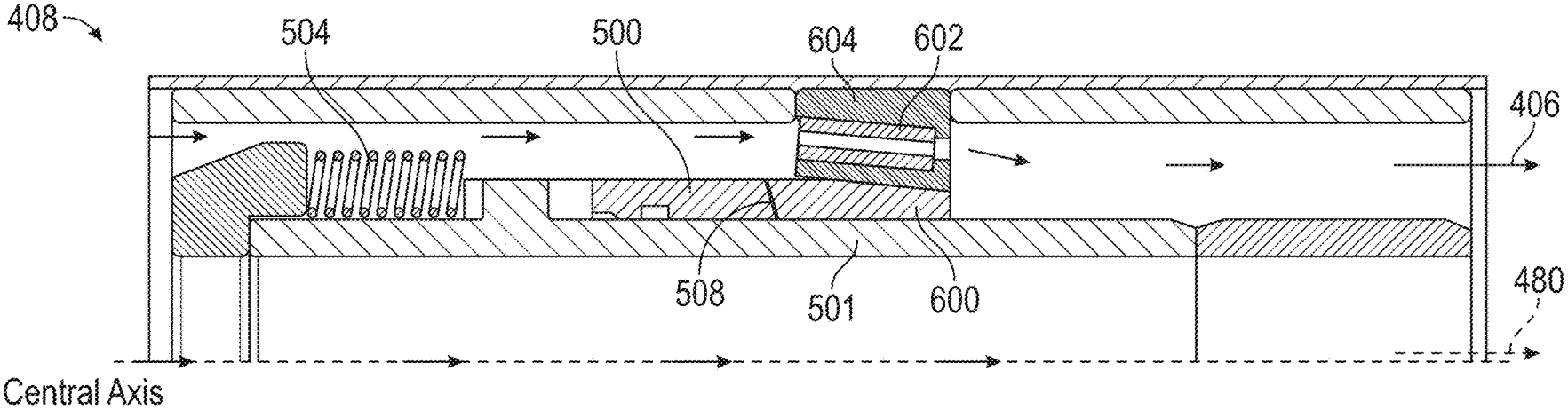
FIG. 6 is a cross-sectional view of another choke assembly for use with a bearing assembly.

The central axis of drill string 102/202 is shown in FIGS. 4-6, where a tool axis flow path 480 is shown which allows the flow of main drilling fluid 216 down the central bore of drill string 102. Rotating choke 500 and stationary seat 502 control the amount of main drilling fluid that is diverted from tool axis flow path 480 to cool and lubricate the bearings. The biasing force shifts rotating choke 500 into contact with the seat such that exemplary choke assembly 408 maintains hydraulic pressure available for pads in the RSS. For example, choke assembly 408 may only allow a range between approximately 1% and approximately 20% of the total drilling fluid 201 to be diverted into the outer bypass fluid flow path 406 but it should be noted that some embodiments may prefer a range between 1% and 7% of the total drilling fluid 201 being diverted into the outer bypass fluid flow path 406. Note that the total drilling fluid 201 may be diverted just before reaching upper bearing assembly 400A, but the selection and arrangement of choke assembly 408 may affect the amount of fluid that is diverted above, at the entrance to the central bore of drive shaft 404. Additionally, rotating choke 500 and/or stationary seat 502 may comprise one or more flow ports 506 extending axially and at an angle through choke 500 and/or stationary seat 502 to ensure that some embodiments have between approximately 1% and approximately 20% of the total drilling fluid 201 passing through choke assembly 408 when rotating choke 500 contacts the stationary seat 502. It should be noted that flow port 506 may further be referred to as a flow restriction, nozzle, insert, slot, orifice, and/or the like. However, other choke assemblies 408 may prefer between approximately 1% and approximately 7% of the total drilling fluid 201 to pass through bypass fluid flow path 406 as appropriate.

With continued reference to FIG. 5, surface to surface abrasion may be found and may be excessive at contact interface 508 between rotating choke 500 and stationary seat 502. Contact interface 508 may be defined as a first surface on rotating choke 500 which faces a second surface on stationary seat 502 wherein each of these surfaces are generally parallel to one another and also rub against one another creating said surface abrasion.

Additionally, velocity erosion may be seen at erosion interface 510 at high velocity erosion orifice 512. To prevent erosion, metal to metal abrasion surface and high erosive velocity flow ports 506 may be far from each other and located within different planes. Note how erosion orifice 512 of flow port 506 is in a different plane and separated from the interface of rotating choke 500 and stationary seat 502 (which creates a seal surface). The number and size of flow ports 506 may be determined by desired restriction. Additionally, flow ports 506 may be angled to minimize erosion concern at the downstream parts. Further, rotating choke 500 and stationary seat 502 may be formed from abrasion resistant carbides. Flow ports 506 may be sintered carbide or 3D printed into stationary seat 502. An alternative embodiment may have flow ports 506 in rotating choke 500 that may create rotating flow jet in the bearing cavity.

FIG. 6, illustrates an example of decoupling the abrasion wear from the erosion wear by using sperate parts for stationary seat. In this embodiment, the stationary seat may comprise a stationary ring 600 and a stationary nozzle housing 604. As illustrated, stationary ring 600 may be disposed on rotational choke carrier 501. During operations, stationary ring 600 undergoes abrasion with rotating choke 500 at contact interface 508. Additionally, a choke nozzle 602 (preferably made of carbide but other materials may be used) may be held within stationary nozzle housing 604. It should be noted that choke nozzle 602 may further be referred to as a flow restriction, flow port, insert, slot, orifice, and/or the like. Ring 600 is separable from choke nozzle 602 so that the two components can be repaired or replaced separately. Stationary ring 600 may be comprised of carbide.

During operations, high speed erosive mud flows through choke nozzle 602. Generally, choke nozzle 602 may be press fit or may have a shoulder to be held within stationary nozzle housing 604, or other holding mechanism may be utilized. In some examples, stationary ring 600 may be taper locked in the inner side of stationary nozzle housing 604 or welded in place. The number of choke nozzles 604, shape and size (Length and diameter) of choke nozzles 604 may vary depending on the desired restriction. Additionally, choke nozzles 604 may be angled to minimize erosion concern at the downstream parts.

Figure 7:
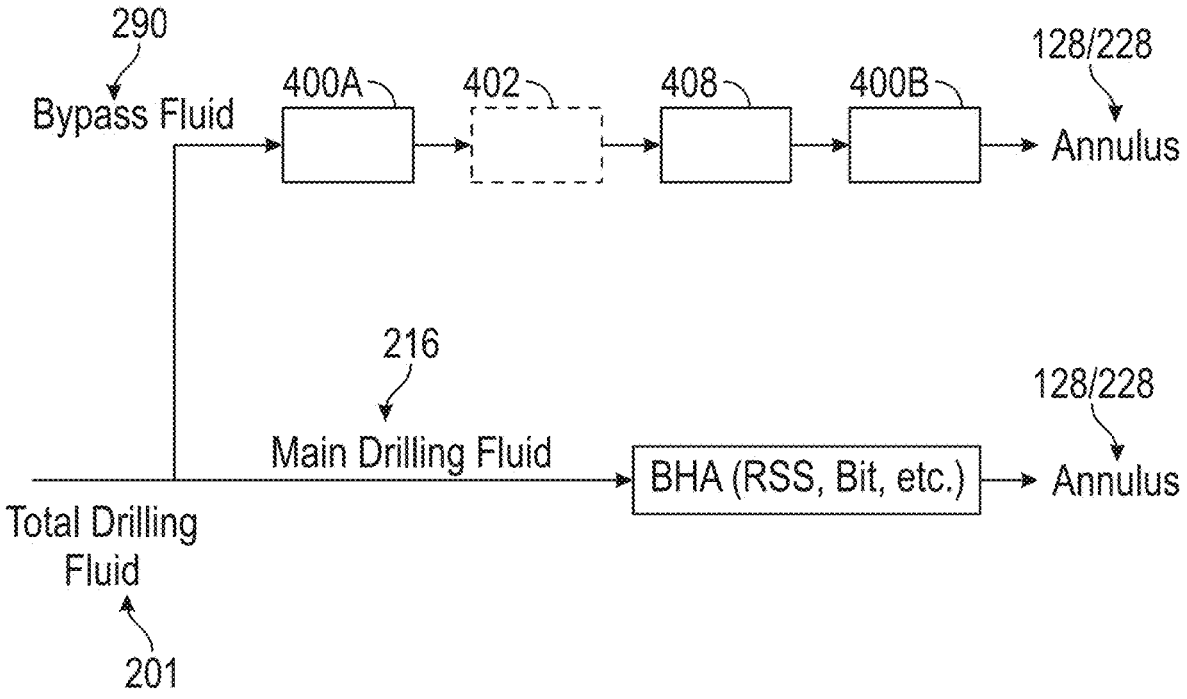
FIG. 7 is a fluid flow diagram showing the flow paths for various drilling fluids through the interior flow paths according to one or more embodiments herein.

FIG. 7 is a fluid flow diagram showing the flow paths for various drilling fluids through the interior flow paths according to one or more embodiments herein. The total drilling fluid 201 may enter at the top of the device as shown and is then diverted into two separate flows: main drilling fluid 216 which travels through tool axis flow path 480 down the central axis of the tool while the bypass fluid 290 is diverted into a bypass fluid flow path 406. After the split/diversion of the total drilling fluid 201, main drilling fluid 216 may continue down the central bore of the drive shaft until reaching a BHA of some type, including but not limited to a bit, RSS, telemetry, or similar, some examples are found in FIG. 2. Once main drilling fluid 216 has passed through the BHA(s) it may then be exhausted into annulus 128/228. After the split/diversion of the total drilling fluid 201, bypass fluid 290 may be directed into a series of bearings as well as the choke assembly 408. In this embodiment, bypass fluid 290 would first be directed into an upper bearing assembly 400A and then optionally through another bearing assembly 402 prior to being directed into choke assembly 408. After passing through choke assembly 408, bypass fluid 290 may then be directed into a lower bearing assembly 400B and eventually exhausted into annulus 128/228. It should be noted that these are only the basic components that interact with these fluids, and it should be known that the fluids may pass through additional components or fewer components depending on the application and it would still be within the scope of this invention. The preceding description provides various examples of the systems and methods of use disclosed herein which may contain different method steps and alternative combinations of components. The methods, systems, and tools may include any of the various features disclosed herein, including one or more of the following statements.

Statement 1: A choke assembly for use with a downhole drill string, the choke assembly may comprise a rotating choke carrier, a stationary seat disposed on the rotating choke carrier, a rotating choke positioned adjacent to the stationary seat to create a seal surface, a biasing mechanism applying a biasing force to press the rotating choke against the stationary seat, and a flow port within the stationary seat which controls drilling fluid to allow some drilling fluid to become a bypass fluid and pass through the stationary seat.

Statement 2. The choke assembly from statement 1, wherein the flow port is positioned away from the seal surface.

Statement 3. The choke assembly from statements 1 or 2, wherein the stationary seat may comprise a ring which contacts the rotating choke and a nozzle which accepts the bypass fluid.

Statement 4. The choke assembly from statement 3, wherein the nozzle is separable from the ring for replacement.

Statement 5. The choke assembly from statement 3, wherein the flow port is positioned within a different plane than an opening of the flow port.

Statement 6. The choke assembly from any previous statements 1, 2, or 3, that may further comprise a tool axis flow path on a first side of the rotating choke carrier and a bypass fluid flow path on a second side of the rotating choke carrier.

Statement 7. The choke assembly from statement 6, wherein the tool axis flow path is positioned to allow main drilling fluid to pass through the choke assembly and the bypass fluid flow path is positioned to allow the bypass fluid to pass through the choke assembly.

Statement 8. The choke assembly from any previous statements 1, 2, 3, or 6, wherein the bypass fluid also contacts one or more bearing assemblies.

Statement 9. A drilling system for drilling a borehole using a main drilling fluid, the drilling system may comprise a drill string, a mud motor coupled to the drill string and comprising a driveshaft comprising a bore with a tool axis flow path through which the main drilling fluid is flowable, and a choke assembly coupled to a bearing housing on a downhole end of the mud motor. The choke assembly may comprise a rotating choke carrier, a stationary seat disposed on the rotating choke carrier, a rotating choke positioned adjacent to the stationary seat, a biasing mechanism disposed against the rotating choke, and a flow port within the stationary seat which allows a bypass fluid to pass through the stationary seat.

Statement 10. The drilling system of statement 9, which may further comprise one or more bearings positioned for rotation of the mud motor and a bypass fluid flow path traversing through the one or more bearings.

Statement 11. The drilling system of statement 10, wherein the bypass fluid flow path is a separate flow path from the tool axis flow path.

Statement 12. The drilling system from any of the previous statements 10 or 11, which may further comprise a rotary steerable system (RSS) positioned on the drill string and downhole of the motor and a pad extending from the RSS and powered at least in part by a hydraulic pressure of the bypass fluid passing through the choke assembly.

Statement 13. The drilling system from any previous statements 10, 11, or 12, wherein the biasing mechanism applies a force in a downhole direction on the rotating choke carrier to force the rotating choke carrier against the stationary seat.

Statement 14. The drilling system from any previous statements 10, 11, 12, or 13, wherein a biasing force is applied against the rotating choke.

Statement 15. A method for using a drilling system, may comprise the steps of running a drill string with a rotary steerable system (RSS) downhole, pumping total drilling fluid down through a central bore of the drill string, and diverting a portion of a drill fluid to produce a bypass fluid which cools one or more bearings of a mud motor and main drilling fluid which travels down the drill string. The method may further comprise biasing a rotating choke against a stationary seat within a choke assembly to resist a hydraulic pressure of the bypass fluid and accepting an amount of the bypass fluid into the choke assembly in order to maintain adequate hydraulic pressure, which may at least in part be used to extend one or more pads on the RSS.

Statement 16. The method of statement 15, wherein the step of diverting a portion of the drill fluid is performed by diverting the bypass fluid into a bypass fluid flow path and diverting the main drilling fluid into a tool axis flow path.

Statement 17. The method of any previous statements 15 or 16, wherein the step of accepting an amount of the bypass fluid to maintain adequate hydraulic pressure is performed by selecting and positioning a flow port in the stationary seat.

Statement 18. The method of any previous statements 15-17, wherein the step of accepting enough of the bypass fluid is performed by accepting the bypass fluid though a flow port positioned on a choke nozzle disposed on a stationary nozzle housing.

Statement 19. The method of any previous statements 15-18, wherein the step of accepting enough of the bypass fluid is performed by accepting the bypass fluid though a flow port positioned on the rotating choke.

Statement 20. The method of any previous statements 15-19, which may further comprise the step of rubbing a stationary ring against the rotating choke within the choke assembly and accepting the bypass fluid through a nozzle in the choke assembly.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A choke assembly for use with a downhole drill string, the choke assembly comprising: a rotating choke carrier;

a stationary seat disposed on the rotating choke carrier, said stationary seat comprising a ring which contacts the rotating choke and a nozzle which accepts the bypass fluid;

a rotating choke positioned adjacent to the stationary seat to create a seal surface;

a biasing mechanism applying a biasing force to press the rotating choke against the stationary seat; and a flow port within the stationary seat which controls drilling fluid to allow some drilling fluid to become a bypass fluid and pass through the stationary seat.

2. The choke assembly from claim 1 wherein:

the flow port is positioned away from the seal surface.

3. The choke assembly from claim 1 wherein:

the nozzle is separable from the ring for replacement.

4. The choke assembly from claim 1 wherein:

the flow port is positioned within a different plane than an opening of the flow port.

5. The choke assembly from claim 1 further comprising:

a tool axis flow path on a first side of the rotating choke carrier; and a bypass fluid flow path on a second side of the rotating choke carrier.

6. The choke assembly from claim 5 wherein:

the tool axis flow path is positioned to allow main drilling fluid to pass through the choke assembly; and the bypass fluid flow path is positioned to allow the bypass fluid to pass through the choke assembly.

7. The choke assembly from claim 1 wherein:

the bypass fluid also contacts one or more bearing assemblies.

8. A drilling system for drilling a borehole using a main drilling fluid, the drilling system comprising:

a drill string;

a mud motor coupled to the drill string and comprising a driveshaft comprising a bore with a tool axis flow path through which the main drilling fluid is flowable;

a choke assembly coupled to a bearing housing on a downhole end of the mud motor, the choke assembly comprising:

a rotating choke carrier;

a stationary seat disposed on the rotating choke carrier said stationary seat comprising a ring;

a rotating choke positioned adjacent to the stationary seat such that the ring contacts the rotating choke;

a biasing mechanism disposed against the rotating choke; and a flow port within the stationary seat which allows a bypass fluid to pass through the stationary seat.

9. The drilling system of claim 8 further comprising:

one or more bearings positioned for rotation of the mud motor; and a bypass fluid flow path traversing through the one or more bearings.

10. The drilling system of claim 9 wherein:

the bypass fluid flow path is a separate flow path from the tool axis flow path.

11. The drilling system from claim 9 further comprising:

a rotary steerable system (RSS) positioned on the drill string and downhole of the motor; and a pad extending from the RSS and powered at least in part by a hydraulic pressure of the bypass fluid passing through the choke assembly.

12. The drilling system from claim 9 wherein:

the biasing mechanism applies a force in a downhole direction on the rotating choke carrier to force the rotating choke carrier against the stationary seat.

13. The drilling system from claim 9 wherein:

a biasing force is applied against the rotating choke.

14. A method for using a drilling system, comprising the steps of:

running a drill string with a rotary steerable system (RSS) downhole; pumping a total drilling fluid down through a central bore of the drill string;

diverting a portion of a drill fluid to produce a bypass fluid which cools one or more bearings of a mud motor and main drilling fluid which travels down the drill string; biasing a rotating choke against a stationary seat within a choke assembly to resist a hydraulic pressure of the bypass fluid;

accepting an amount of the bypass fluid into the choke assembly in order to maintain adequate hydraulic pressure, which may at least in part be used to extend one or more pads on the RSS; and rubbing a stationary ring against the rotating choke within the choke assembly and accepting the bypass fluid through a nozzle in the choke assembly.

15. The method of claim 14 wherein:

the step of diverting a portion of the drill fluid is performed by diverting the bypass fluid into a bypass fluid flow path and diverting the main drilling fluid into a tool axis flow path.

16. The method of claim 14 wherein:

the step of accepting an amount of the bypass fluid to maintain adequate hydraulic pressure is performed by selecting and positioning a flow port in the stationary seat.

17. The method of claim 14 wherein:

the step of accepting enough of the bypass fluid is performed by accepting the bypass fluid though a flow port positioned on a choke nozzle disposed on a stationary nozzle housing.

18. The method of claim 14 wherein:

the step of accepting enough of the bypass fluid is performed by accepting the bypass fluid though a flow port positioned on the rotating choke.

* * * * *